United States Patent [19]

Tetenborg

[11] Patent Number: 4,628,535

[45] Date of Patent: Dec. 9, 1986

[54] LARGE SACK COMPRISING A DOUBLE-WALLED OUTER SACK AND AN INSERTED INNER SACK

[75] Inventor: Konrad Tetenborg, Lengerich, Fed. Rep. of Germany

[73] Assignee: Windmoller & Holscher, Lengerich, Fed. Rep. of Germany

[21] Appl. No.: 470,437

[22] Filed: Feb. 28, 1983

[30] Foreign Application Priority Data

Mar. 1, 1982 [DE] Fed. Rep. of Germany ..... 3207322

[51] Int. Cl.[4] ..... B65D 33/00; B65D 33/14; B65D 33/16

[52] U.S. Cl. ..... 383/24; 383/71; 383/109; 383/114; 383/121

[58] Field of Search ..... 383/24, 41, 71, 109, 383/114, 122, 121; 222/105, 181

[56] References Cited

U.S. PATENT DOCUMENTS

| | | | |
|---|---|---|---|
| 2,581,826 | 1/1952 | Yount | 383/109 X |
| 2,721,691 | 10/1955 | Makrauer | 383/109 X |
| 3,061,170 | 10/1962 | Baker | 383/109 |
| 3,540,356 | 11/1970 | Lecomte | 383/114 X |
| 3,670,954 | 6/1972 | Leventhal | 383/114 X |
| 3,789,897 | 2/1974 | Saito | 383/109 X |
| 3,851,688 | 12/1974 | de Winter | 383/41 X |
| 3,945,562 | 3/1976 | Brockmuller | 383/109 X |
| 4,136,723 | 1/1979 | Skaadel et al. | 383/24 X |
| 4,174,804 | 11/1979 | Bosse | 383/109 |
| 4,191,229 | 3/1980 | Skaadel et al. | 383/122 X |
| 4,222,422 | 9/1980 | Lofberg | 383/109 X |
| 4,253,507 | 3/1981 | Williamson | 383/71 X |
| 4,274,896 | 6/1981 | Bosse | 383/109 X |

FOREIGN PATENT DOCUMENTS

| | | | |
|---|---|---|---|
| 1009624 | 3/1952 | France | 383/41 |
| 2055752 | 3/1981 | United Kingdom | 383/7 |

*Primary Examiner*—William Price
*Assistant Examiner*—Sue A. Weaver
*Attorney, Agent, or Firm*—Fleit, Jacobson, Cohn & Price

[57] ABSTRACT

A sack comprises an inner container and a double-ply outer container which latter comprises a tubular or essentially tubular section of which the opposed severed edges are interconnected by a seam. Alternatively, the outer container comprises two such sections having their severed edges interconnected by respective seams.

11 Claims, 8 Drawing Figures

A
B
1
2
3
4
5
6
6f
6o
6s
6t
7
8
9
10
11
11i
12
1c

LARGE SACK COMPRISING A DOUBLE-WALLED OUTER SACK AND AN INSERTED INNER SACK

The invention relates to a large sack comprising an outer sack consisting of a tube member with double-ply walls of film or fabric material of high strength and an inserted inner sack, wherein the lower end of the tube member is pulled together to form the sack base and is held together by a rope or band and the upper rim is formed by the folded or turned over edge which joins the inner and outer sack wall and is interrupted by at least two longitudinal incisions or recesses, and wherein at least one carrying rope or band ruffling the mouth together is threaded through the wall loops opened up by the incisions.

In a sack of this kind known from DE-GMS No. 81 11 188, the tube member forming the outer sack and having double-ply walls is made in that a rim of a tube member is pulled inwardly whereby the tube section is, so to speak, inverted to such an extent that the inwardly pulled half of the tube member forms the inner wall of the outer sack. The seamless upper rim of the tube member is then provided at opposite sides with longitudinal incisions so that two wall loops are defined by the inner and outer walls into which a ring of rope is inserted to form a carrying loop to be suspended from the hook of a crane for lifting and moving the sack. Despite high strength, this known large sack has the disadvantage that it has to be substantially hand made because no machines are available which are, at a viable cost, able to convert the tube sections to tube members with an inverted inner sack wall.

U.S. Pat. No. 3,789,897 discloses a similar large sack having the same disadvantage that the tube member forming the outer sack has to be made by pulling in or inverting part of a tube section into the other, which is basically impossible to do by machine.

The problem to be solved by the invention therefore, is to provide a large sack of the aforementioned kind which can be substantially machine-made without manual work.

According to the invention, this problem is solved in that the tube member is a tubular or essentially tubular section of which the opposed severed edges are interconnected by a seam. The supporting outer sack of the large sack according to the invention can thus be simply made mechanically and without complicated equipment in that one half of a tube section is laid on the other and the superposed severed edges of the tube section are sewn together or otherwise interconnected to form the tube member.

Instead of folding one tube section and interconnecting its severed edges, it is also possible for the tube member forming the outer sack to be of two tubular or essentially tubular sections which have their severed edges interconnected by respective seams.

According to a particularly advantageous embodiment, in a tube member formed by at least one tube section, the folded edge on the base side is provided on both sides of the seam or seams with incisions through which the knotted ends of the rope or band pulling the base together are passed. This embodiment permits a particularly strong construction for the base because there are no seams to form the base and it is not necessary to intertwine freely terminating sack walls with ropes and knot them to form the base as is required for known large sacks. In known sacks, the bases therefore constitute points of weakness which are avoided in the sack of the invention in that the tube sections forming the tube member of the sack are arranged to extend in an annulus. To prevent the inserted inner sack from being pushed through the pulled-together base, a reinforcing sheet can be placed on the pulled-together base zone.

The tube section forming the outer sack desirably consists of a circular woven tube of stretched plastics bands. The inner sack can be a conventional sack of plastics film.

A method for making the large sack of the invention is characterised according to the invention in that a flattened tubular or essentially tubular section is provided with two incisions or slots at the upper folded edge which later forms the filling side, dabs or strips of adhesive are applied to one side of the section and the flattened inner sack is laid on one half of this side at a spacing from the subsequent side edges of the sack, that the other half is folded into registry with the inner sack onto the first half and the superposed margins of the section are interconnected by a sewn seam, and that ropes with outwardly protruding ends are threaded into or previously inserted in the wall loops formed by the upper and lower edges of the section.

The side edges of the flattened inner sack are preferably folded inwards so that, during filling, the inner sack can expand without stress and come to lie against the inner walls of the supporting outer sack.

Examples of the invention will now be described in more detail with reference to the drawing, wherein:

FIG. 1*a* shows a flattened textile tube section for making the outer sack;

FIG. 1*b* is a plan view and schematic side elevation of the tube section with the flattened inner tube placed thereon;

FIG. 1*c* is a plan view and schematic side elevation of the tube section folded to form an outer sack with an inserted inner sack;

FIG. 1*d* is a schematic view of a portion of an alternate arrangement for the inserted inner sack shown in FIG. 1*b*.

Figures 1A, 1B, 1C, 1D:
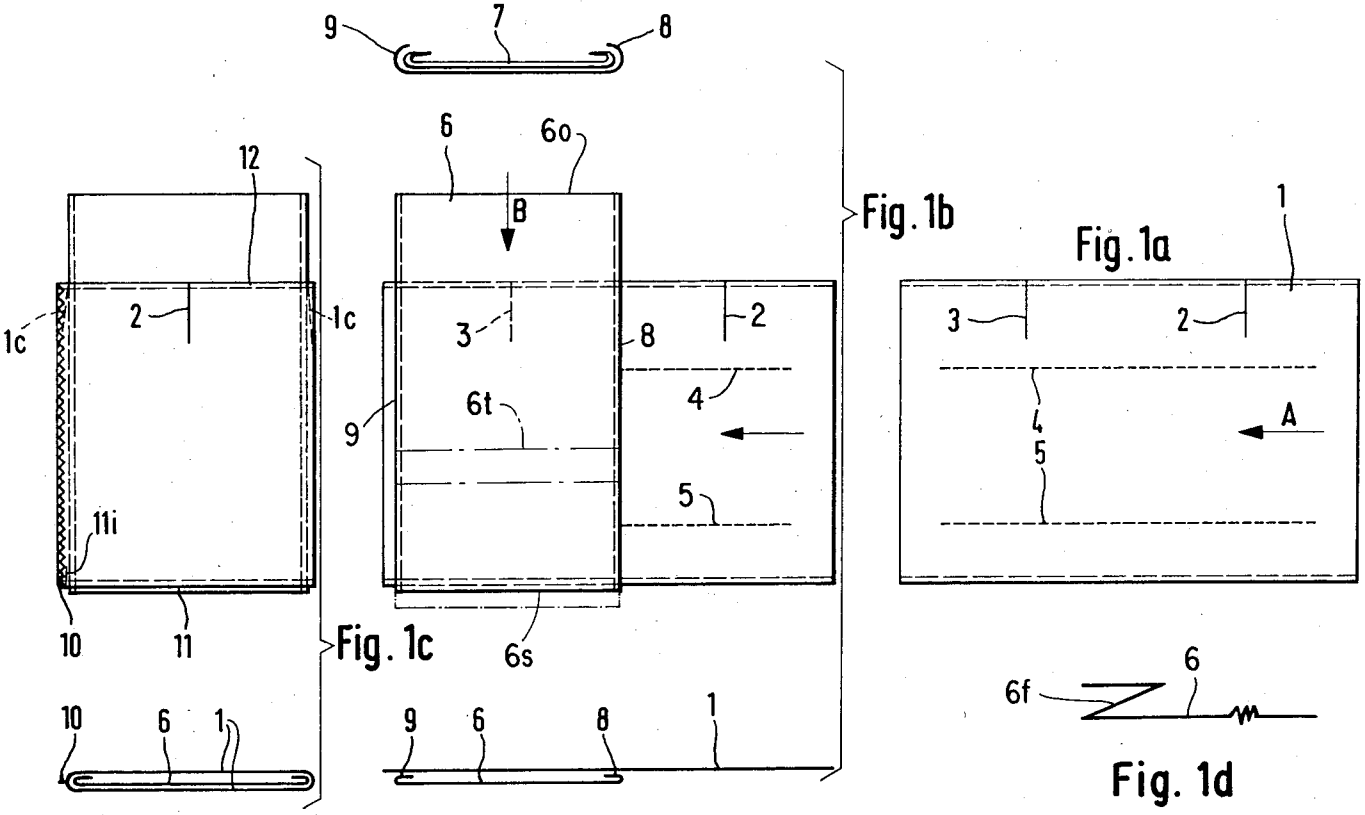
Figure 2:
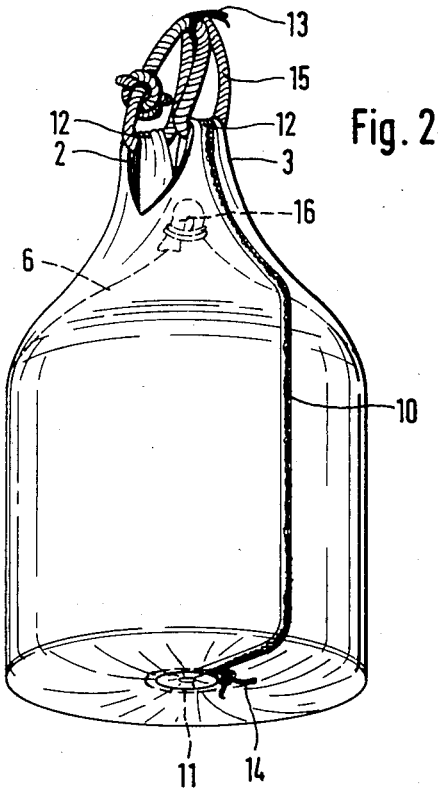
FIG. 2 is a perspective view of a filled large sack made by the method described in relation to FIG. 1.
Figure 3:
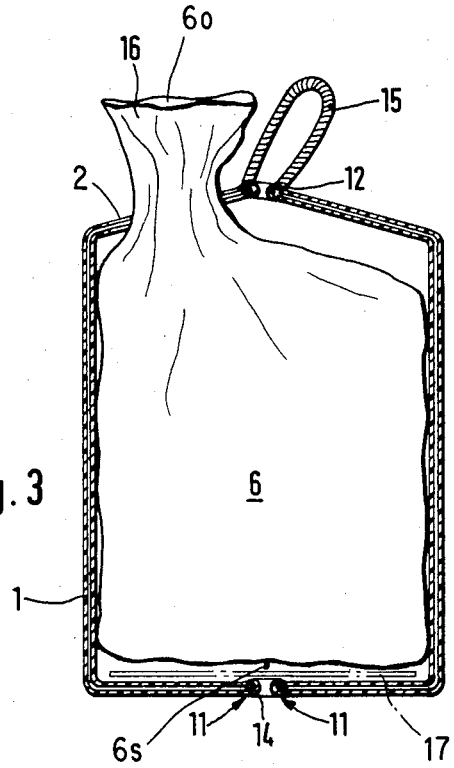
FIG. 3 is a section through the large sack of FIG. 2.
Figure 4:
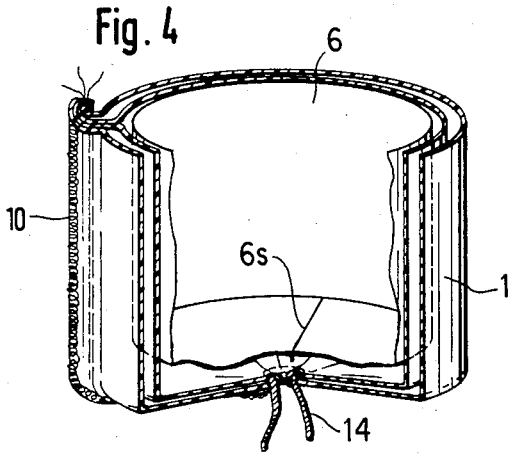
FIG. 4 is a perspective view and part section of the base formation of the FIG. 2 sack.

To make the sack shown in FIGS. 2 to 4, a longitudinally extending tubular section 1 of plastics tape fabric, having opposite longitudinally extending folded edges, is conveyed in the direction of the arrow A in FIG. 1*a*. The upper rim of the tubular section 1 is provided with two incisions or slots 2, 3 which sever the rim and extend inward essentially perpendicularly from the rim, and which are spaced apart by a distance equal to about half the length of the tubular section as shown in FIG. 1*a*. The slots or incisions 2, 3 could have a position relatively to each other different from that illustrated and could be applied at a different stage in the method. In the alternative, upper corners 1*c* of the outer sack 1, as shown in FIG. 1*c*, could be cut off along the broken lines illustrated in that figure. Two longitudinal rows 4 and 5 of dabs of glue also are applied to the side of the tube member 1 facing the viewer. It is also possible to provide several strips of dabs of glue; and the dabs need not be applied in rows. Onto the tube member 1 prepared as described, the inner sack 6 is then, as shown in FIG. 1*b*, supplied in the direction of arrow B, i.e. transversely to the direction of travel of tubular section 1, and, after the margins 8 and 9 of the tube of film have been placed about a shoe 7 to produce folded edge portions as shown in FIG. 1*b*, the film is placed on tube section 1. The latter is then folded onto itself as shown in FIG. 1*c*, into a flattened, extended condition, to produce superposed edge portions along a left-hand side thereof and a folded portion along an opposite, right-hand side thereof, as viewed in this figure. The inner sack 6, as is best shown in FIG. 3, has a lower end closed by a seam 6*s* and an upper open end 6*o*.

Instead of folding the side edges of tubular film 6 inwardly about a shoe 7, one can also insert a film sack with Z shaped side folds 6*f*, as illustrated schematically in FIG. 1*d*. What is important is that the inner film sack 6 be so narrow that the sewn seam 10 connecting the superposed severed edges of tube section 1, which extend transversely between respective ends of the longitudinally extending folded edges of the tube section, can be produced without hindrance and the inner sack can during filling come to lie against the side walls of the supporting outer sack without stressing the inner sack. The tubular film 6 also may be formed with a transverse fold 6*t*, illustrated by broken lines in FIG. 1*b*, if so desired.

By means of the single side seam 10, the tubular section 1 is then formed to a double-ply tube member having seamless upper and lower longitudinally extending edges or borders as well as the single side seam 10, in which the inner film sack 6 is fixed by the rows of glue dabs 4 and 5. Before forming the side seam 10, the superposed severed edges of tubular section 1 are folded over together and the seam is produced through the folded-over margin.

If, now, a band or rope 14 (FIGS. 2, 3 and 4) is inserted in the lower folded edge or border 11 which is in the form of a loop formed by the sack walls, with the ends of such band or rope protruding from the border, for example, in the zone where it is intersected by the side seam 10, the base of the sack can be formed merely by pulling portions of the rope together and knotting the two rope ends together as shown in FIG. 2. For this purpose, in order to insert the band or rope 14 in the lower border 11 as shown in FIGS. 2, 3 and 4, a pair of small incisions 11*i* (FIG. 1*c*) are made in the lower border 11 adjacent the side seam 10.

Into the upper folded edge or border 12 there is also placed a band or rope 15 (FIG. 2) the ends of which are knotted together in the zone of one of the two slots 2 or 3. The visible rope portions in the zone of the two slots 2 and 3 are then brought together by means of a clip 13 so that, as shown in FIG. 2, only a single eye is formed which can be simply grasped by the crane hook.

FIG. 2 shows the sack made by the described method with a side seam 10 and the lower border 11 which was ruffled together by the rope 14 to form a base. At the filling end of the sack one can see the two slots 2 and 3 and portions of the border 12 ruffled together separately by the rope 15 to form a mouth for the outer sack 1. As is shown in FIG. 2, after filling, the upper margin 16 of the filling end of the inner tube of film 6 is tied together. FIG. 3 shows that, prior to filling, the upper margin 16 is pulled out of the supporting outer tube 1 at one of the slots 2 or 3 so that a filling funnel can be introduced. During filling, the entire sack is suspended from a crane hook. In order that the inner tube 6 may expand freely in the outer tube during filling, it is necessary for the inner film tube 6 to be somewhat larger than the supporting outer tube 1. If required, fixing of inner tube 6 by the rows of glue dabs 4 and 5 can be so weak that the fixing points become detached without destroying the material. The fixing points only serve to ensure that, as the supporting outer sack 1 is pulled open, the inner film tube is pulled open with it without the need for inflating the inner tube 6 with air.

Figure 5:
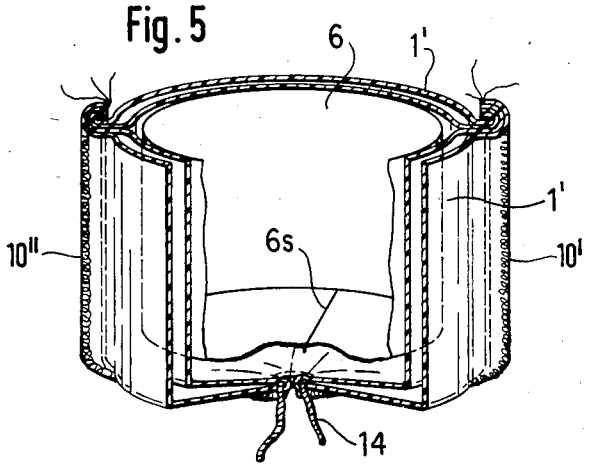
FIG. 5 shows a base formation of a sack corresponding to FIG. 4, where the outer sack consists of two tubular sections sewn together.

FIG. 4 shows the base region of a sack according to FIG. 2 in perspective view whilst FIG. 5 shows the base zone of a sack made by a different method from that described for FIG. 1. More particularly, in the modified method, instead of a longer tube member 1 which is folded onto itself, two smaller tube members 1 are superposed so that one obtains longitudinally extending seamless upper and lower edges or borders and two side seams 10' and 10'' instead of one, extending transversely between respective ends of the folded edges.

The sack as described is particularly strong because the supporting outer sack 1 is of two layers such that a lower and an upper seamless border 11 and 12, respectively is formed, a ring of rope 14 or 15 being placed in each of the borders by means of which they can be ruffled. Ruffling in the base zone takes place before filling and at the filling end when the sack is lifted by a crane by way of the rope ring 15.

In the sack as described, there are only side seams, such as 10, or 10' and 10'' but no base or top seams extending transversely to the load direction and leading to actual points of weakness in sacks of large capacity.

The inserted inner tube film 6 can be welded shut to form the seam 6*s*, or tied at the base. Further, the base end of the inner film sack 6 can be folded over to enable it to expand freely during filling.

To prevent the inner film sack 6 from pushing through the small aperture remaining after knotting the base of the outer sack 1, a cover sheet 17 (illustrated by broken lines in FIG. 3) can be placed over this aperture. The cover sheet may be applied before folding the tubular section 1 over and before placing the inner sack 6 on the tubular section 1 and could be connected thereto.

I claim:

1. A large sack construction, comprising an outer sack formed by an essentially tubular member having double-ply walls, the walls having inner and outer wall portions joined by first and second opposite folded edges of the member which extend longitudinally when the outer sack is in a flattened, extended condition, and the walls also having at least one set of superposed severed edge portions extending transversely between respective ends of the opposite folded edges and interconnected by at least one seam, an inner sack inserted within the outer sack, first band means extending through a loop formed by the first folded edge of the essentially tubular member with portions of the first folded edge being ruffled together and held together by the first band means to form a base for the outer sack, second band means extending through loops formed by portions of the second folded edge of the essentially tubular member, the loops of the second folded edge being formed by slots in the essentially tubular member extending inwardly from the second folded edge, and portions of the loops of the second folded edge being separately ruffled and held together by the second band means to form a mouth for the outer sack.

2. The large sack construction according to claim 1, wherein the essentially tubular member is formed by two essentially tubular sections forming respective portions of the opposite first and second folded edges and having two sets of superposed severed edge portions at opposite sides thereof, the sets of superposed edge portions extending transversely between respective ends of the portions of the opposite first and second folded edges and being interconnected by respective seams.

3. The large sack construction according to claim 1, wherein the first band means extends into the loop formed by the first folded edge through incisions in the first folded edge adjacent the at least one seam interconnecting the superposed edge portions of the double-ply walls.

4. The large sack construction according to claim 1, wherein the inner sack is provided with at least one fold to facilitate expansion of the inner sack in the outer sack.

5. The large sack construction according to claim 4, wherein the one fold is a transverse fold.

6. The large sack construction according to claim 4, wherein the one fold is a Z-fold.

7. The large sack construction according to claim 4, wherein the inner sack is provided with side folds in the form of laterally folded-in margins.

8. The large sack construction according to claim 1, wherein the outer sack defines corners when the outer sack is in the flattened, extended condition and the slots in the outer sack are formed by cut-off portions of the corners.

9. The large sack construction according to claim 1, wherein a filling aperture of the inner sack can be passed through one of the slots in the outer sack.

10. The large sack construction according to claim 1, wherein a reinforcing base sheet extends over the interior of the outer sack base formed by the ruffled first folding edge.

11. The large sack construction according to claim 1, wherein the outer sack, when in the flattened, extended condition, has a folded portion extending transversely between the opposite folded edges of the tubular member at an opposite side of the outer sack from the superposed severed edge portions interconnected by the at least one seam.

* * * * *